United States Patent [19]

Feick

[11] Patent Number: 5,060,754

[45] Date of Patent: Oct. 29, 1991

[54] STANDING POSITION BACK SUPPORT

[76] Inventor: Murray L. Feick, 167 Sweetbriar Drive, Kitchener, Ontario, Canada, N2M 4S9

[21] Appl. No.: 626,529

[22] Filed: Dec. 12, 1990

[51] Int. Cl.[5] ..... A47C 16/00

[52] U.S. Cl. ..... 182/82; 182/113; 182/230

[58] Field of Search ..... 182/230, 129, 82, 113, 182/112; 297/452, 460

[56] References Cited

U.S. PATENT DOCUMENTS

| | | | |
|---|---|---|---|
| 3,976,155 | 8/1976 | Esch | 182/230 |
| 4,458,784 | 7/1984 | Holmes | 182/230 |
| 4,493,393 | 1/1985 | Serber | 182/230 |
| 4,727,958 | 3/1988 | Botello | 182/230 |
| 4,964,487 | 10/1990 | Webb | 182/230 |
| 5,022,622 | 6/1991 | Schaevitz | 182/230 |

*Primary Examiner*—Reinaldo P. Machado
*Attorney, Agent, or Firm*—Daryl W. Schnurr

[57] ABSTRACT

A back support is used by a user in a standing or leaning position and has a back rest that can be adjusted to the proper height and oriented to support the user's low back. The back support has a forward bias so that when the user leans against it, the support means rearward and when the user separates from it the support moves forward to a rest position. The back rest can be used for brief rest periods for workers who are normally in a standing position during an entire shift. The back support can also be used by a worker who can lean against the back rest while working. In an assembly line job, there is often insufficient time for a worker to actually sit down to rest while waiting for another work piece. With the present invention, the worker can rest easily for very brief periods of time.

12 Claims, 6 Drawing Sheets

STANDING POSITION BACK SUPPORT

BACKGROUND OF THE INVENTION

1. Field of the Invention

This invention relates to a back support for use by persons while in a standing or leaning position. In particular, this invention relates to a back support that can be used by a worker who wishes to take a brief rest or, alternatively, wishes to work in a leaning position.

2. Description of the Prior Art

It is known that persons who have jobs that require them to be on their feet during virtually an entire work period often suffer from lower back pain either during the work period, after the work period or both. This pain usually worsens with time and with age. Often the type of work is such that a worker has a brief rest period, for example, thirty seconds every two minutes, but it is not worth the effort required of the worker to find a suitable resting position such as a chair as the worker must get up almost immediately. Workers who are on assembly lines often have a rest period as they are waiting for the next component or next product to travel along the assembly line to their work station. As a further example, bank tellers generally have no place to rest between customers. There is usually an insufficient time interval to enable them to seek out a chair and, in a short time, it is not worth sitting down as one has to get up too soon.

SUMMARY OF THE INVENTION

A back support for use by a user in a standing or leaning position has a base and a longitudinal member having an upper end, a lower end and a front. The lower end is securely mounted to said base and the upper end extends slightly forward of said lower end when said support is in a rest position. The upper end supports a back rest at said front with adjustment means to adjust said position of the back rest to correspond to a level and orientation of a lower back of the user. The upper end of said longitudinal member is movable in a vertical plane so that when a user stands or leans against the back rest, the upper end moves rearward in response to a weight of the user and when a user moves away from the back rest, the upper end returns to said rest position. The support provides a resilient force in a direction to assist a user in separating from said support.

DESCRIPTION OF A PREFERRED EMBODIMENT

Figures 1, 2:
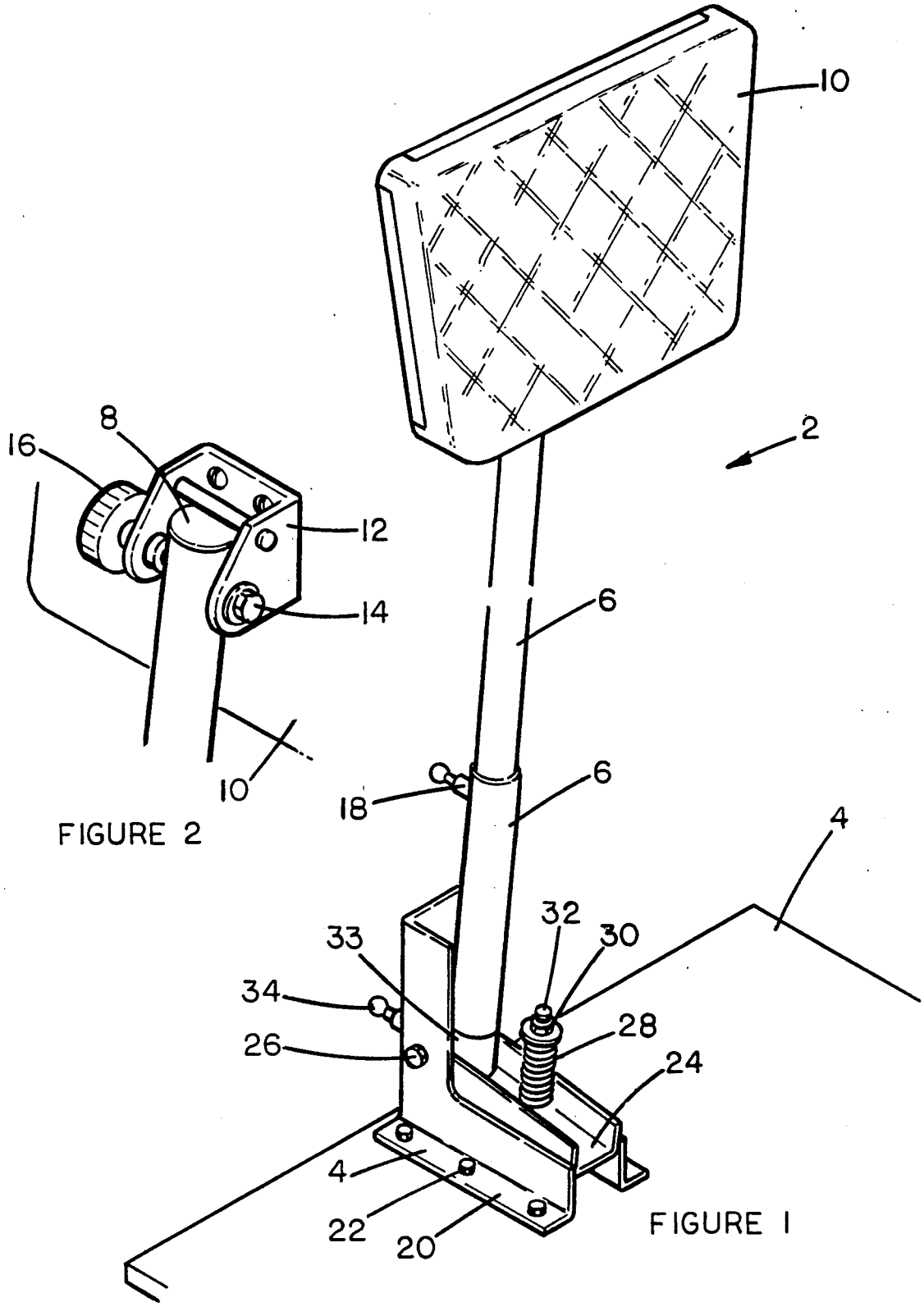
FIG. 1 is a partial perspective view of one embodiment of the invention.
FIG. 2 is a partial perspective rear view of a back rest connected to a longitudinal member.

Referring to the drawings in greater detail, in FIGS. 1 and 2, a back support 2 has a base 4 with a longitudinal member 6. The longitudinal member 6 has an upper end 8 with a back rest 10 mounted thereon. The back rest 10 is secured to a bracket 12 which is pivotally mounted on a bolt 14 extending through the longitudinal member 6. The tightness of the bolt 14 is adjustable through handle 16 so that the back rest 10 can be pivoted within a vertical plane upward or downward to any reasonable angle that a user finds comfortable. Alternatively, the back rest 10 can be left free to float freely about the bolt 14 to a natural inclination. The longitudinal member 6 is preferably a post having a cylindrical shape that is divided into two parts, one part slidably fitting within the other, the diameter of the lower part being slightly larger than the diameter of the upper part. There are releasable locking means 18 so that the vertical height of the back rest 10 can be adjusted relative to the supporting surface and then fixed in the desired position. In the embodiment shown in FIG. 1, the locking means 18 is a pin (not shown) that is preferably spring-mounted and extends into two aligned openings (not shown), one in the larger post 6 and one in the smaller post 6 when the back rest is at the desired height. The smaller post 6 preferably has a plurality of openings along its rear edge (not shown) so that it can be adjusted longitudinally relative to the larger post 6 over a broad range with the pin being inserted into one of the openings at the desired height. The larger post 6 has one opening aligned with the pin. As this adjustment means is considered to be conventional, it is not shown in detail in the drawings.

The base 4 shown in FIG. 1 is preferably large enough and heavy enough to provide stability for the back support 2. Usually, the base 4 will be large enough that the user will stand on the base 4 to provide additional weight and therefore stability when the back support is in use. Also, the base 4 could extend much further rearwardly, than shown in FIG. 1, of the post 6 relative to the longitudinal member 6 to provide additional support to a user. In the embodiment shown in FIG. 1, the support 4 is not attached to any other supporting surface and the back support can be moved readily to any desired location.

Figure 3:
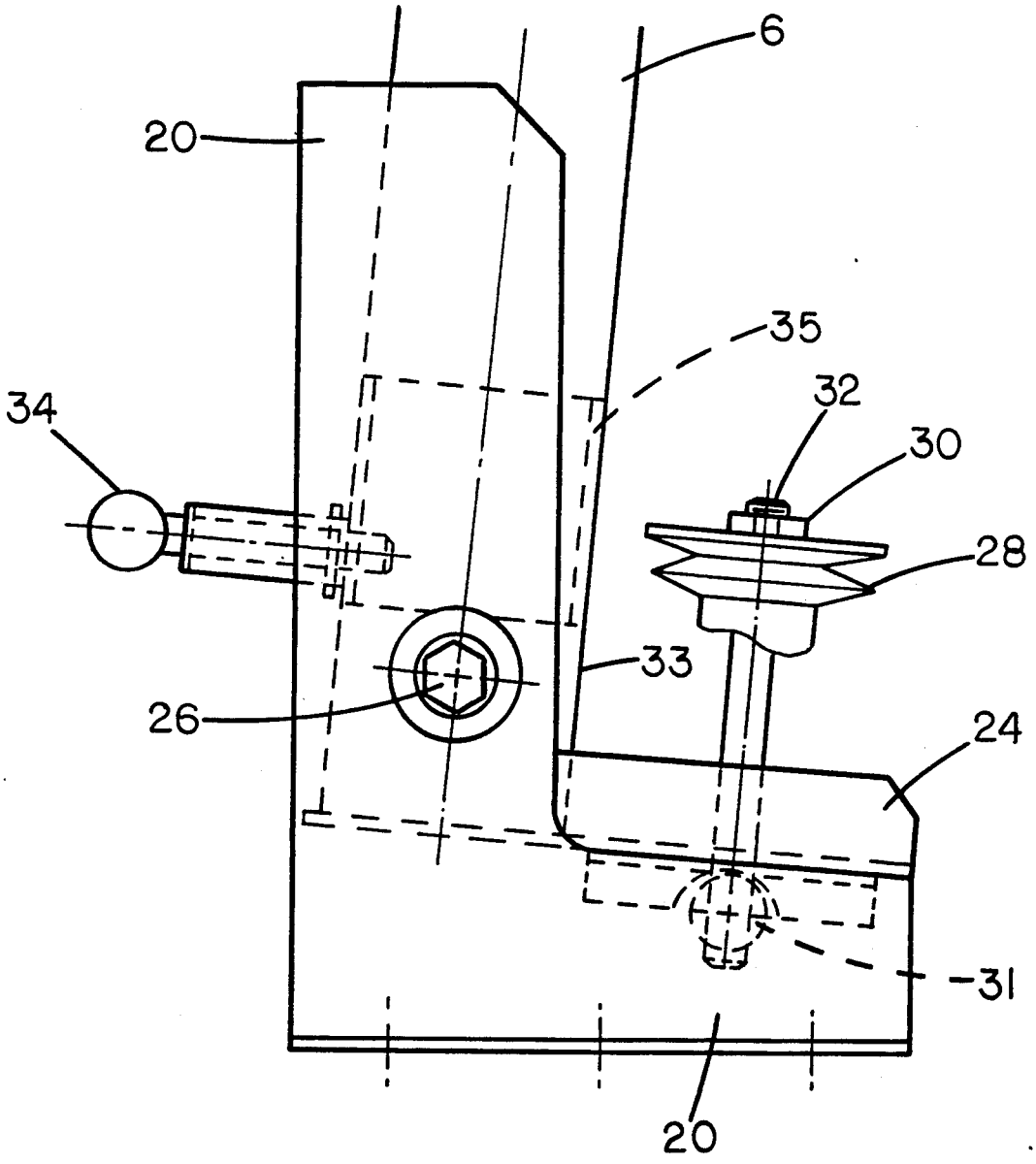
FIG. 3 is a side view of a spring-mounting located at a base of FIG. 1.

The details of a connection between the lower end of the post 6 and the base 4 is shown in greater detail in FIG. 3. As can readily be seen, an L-shaped channel bracket 20 is fixedly secured to the base 4 by bolts 22. The post 6 has a U-shaped bracket 24 affixed to a lower end thereof, said U-shaped bracket extending forwardly from the end of said post 6. Preferably, the bracket 24 is welded to the post. The post 6 is pivoted within the channel-shaped bracket 20 about a bolt 26. When the upper portion of the post 6 moves backward in response to a person leaning on the back rest 10, the post 6 will pivot about the bolt 26 and will tend to lift the U-shaped channel 24 upward against a bias of a spring 28. The spring 28 is under compression and when the tension in the spring 28 is adjustable by means of a nut 30 on a threaded bolt 32 which extends along a longitudinal centre line of the spring. The bolt 32 is pivotally anchored on a pin 31 mounted in the bracket 20. The pivotal feature allows the spring 32 to compensate for the change in angle of the bracket 24 as the post 6 moves forward or backward. The force of the spring 28 thus limits the rearward movement of the upper portion of the post 6. If sufficient force is applied to the back rest 10 to overcome the force of the spring 28 the rearward movement of the post 6 will be limited by a rear edge of the post abutting the bracket 20. At the same time, when a user desires to separate from the back rest 10, the spring 28 will return the back rest 10 forward to its initial position, thereby providing assistance to the user. The forward limitation of movement occurs when the spring 28, which is anchored to the bracket 20 forces the bracket 24 against the anchoring means (not shown) for the spring 28. The spring 28 is only partially shown in FIG. 3 for ease of illustration. Preferably, the lower portion of the post 6 has a bottom section 33 that can be separated from a remainder of the post 6 by removing a spring-mounted pin 34. From FIG. 3, it can be seen that the lower end of the post 6 has a plug 35 that fits within the section 33 and has an opening (not shown) to receive the pin 34. The pin 34 releasably locks the post on the base and allows the post and back rest to be separated from the base 4. If it is not desired to separate the post from the base, the bottom section 33 can be omitted and the post pivoted directly on the bolt 26.

Figure 4:
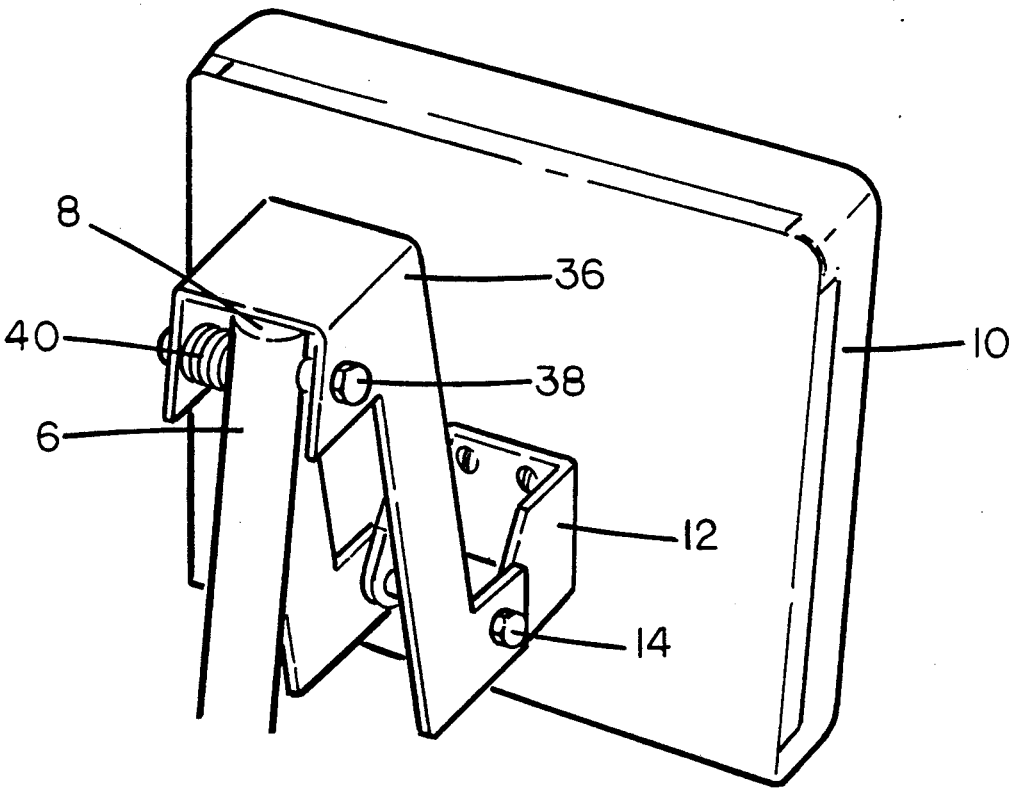
FIG. 4 is a partial perspective rear view of another embodiment of the invention.
Figure 4:
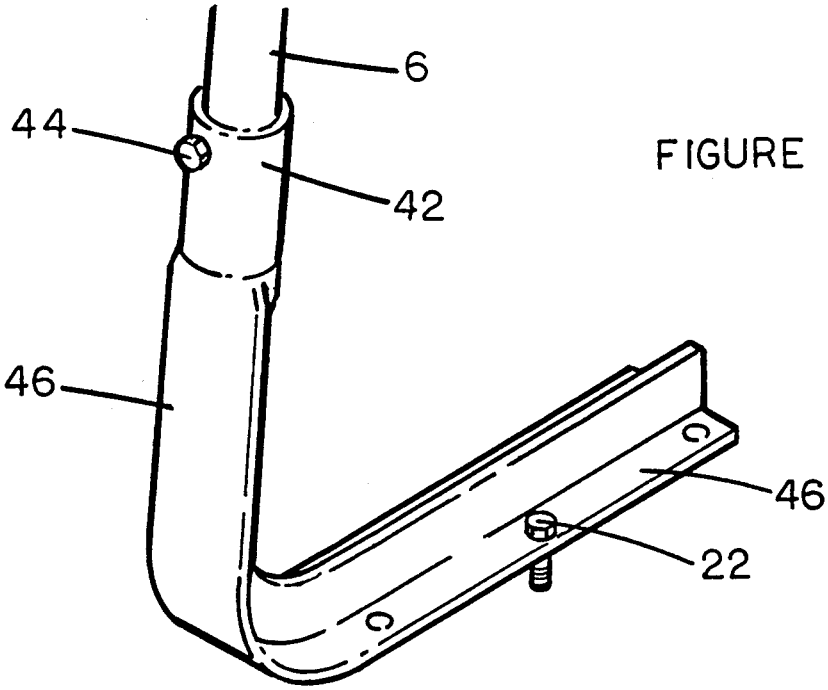

In FIG. 4, there is shown a further embodiment of the invention. For simplification purposes, the same reference numerals as those used in FIGS. 1, 2 and 3 are used for those components shown in FIG. 4 that are similar or identical to the components shown in FIGS. 1, 2 and 3. The back rest 10 has a bracket 12 located thereon that is pivoted on a bolt 14 to a Z-shaped bracket 36. The Z-shaped bracket 36 is in turn pivoted, at an end opposite to the end near the bolt 14, about a bolt 38. The bolt 38 extends through an upper end 8 of the post 6 and has a spring 40 mounted thereon. The spring 40 is biased against the clockwise rotation of the bracket 36 about the bolt 38 when viewed from the position shown in FIG. 4. In other words, as pressure is placed against a front of the back rest 10 (not shown in FIG. 4), the spring 40 will resist that pressure and will return the back rest to its initial position when the pressure is removed. The telescoping feature of the post 6 shown in FIG. 1 has been omitted from FIG. 2 but could, of course, be included. A lower portion of the post 6 is secured within a cylindrical section 42 by a bolt 44. The cylindrical section 42 is affixed to a base 46 having a T-shaped cross-section. The base 46 can be bolted into a base similar to base 4 shown in FIG. 1 or it can be bolted directly into a supporting surface, for example, a metal plate embedded in a concrete floor by bolts 22. The shape of the base 46 provides some spring-like movement and resiliency as pressure is placed on the back rest 10 by a user. However, in the embodiment shown in FIG. 4, most of the pressure and resiliency is provided by the spring 40.

Figure 5:
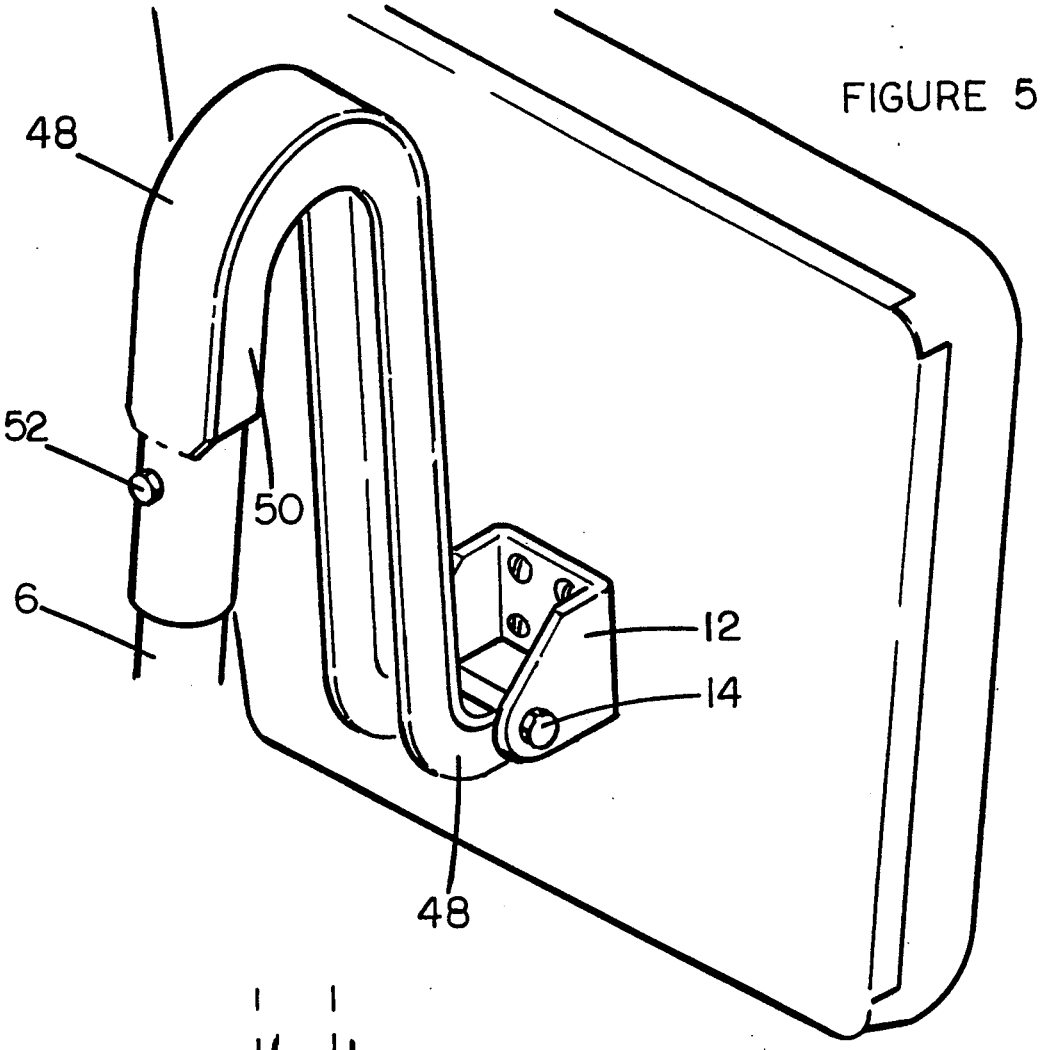
FIG. 5 is a partial perspective rear view of still another embodiment of a back rest connection.

In FIG. 5, there is shown still a further embodiment where the back rest 10 has a bracket 12 that is pivotally mounted on a bolt 14 connected to an S-shaped bracket 48. The S-shaped bracket 48 has an end 50 which is fixedly secured by a bolt 52 to an upper end of the post 6. As pressure is placed on the back rest 10, the S-shaped bracket 48 provides some resistance to that pressure and some resilience to return the back rest to its initial position when the pressure is removed.

Figure 6:
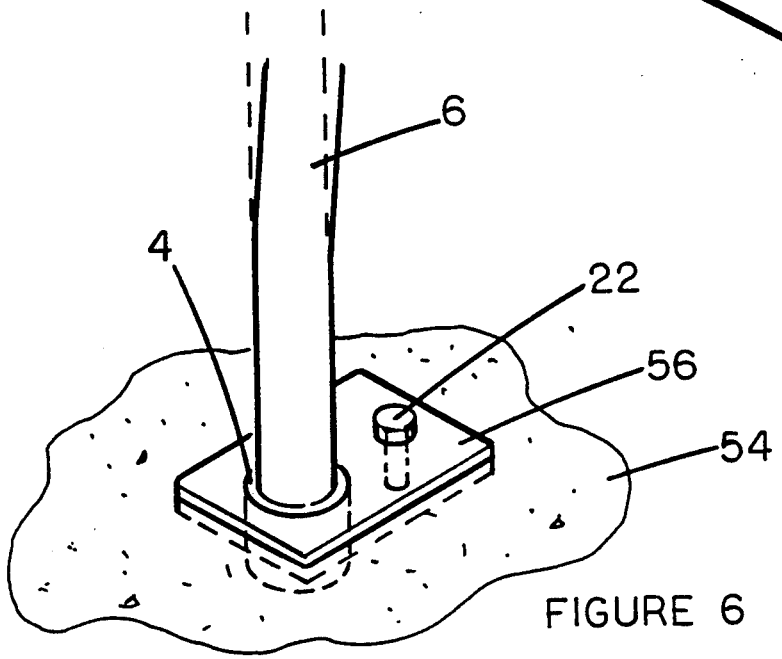
FIG. 6 is a partial perspective view of a flexible and resilient longitudinal member.

In FIG. 6, the post 6 is designed of a material (for example, steel) that is sufficiently flexible and resilient to permit the entire post to flex somewhat under the pressure of a user against the back rest 10 (see the position shown by the dotted lines) and to return to its initial position (see solid lines) when the pressure is removed. It can be seen that the base 4 of the post 6 is embedded in a concrete floor 54 and covered by a metal plate 56 bolted to said floor by a bolt 22.

Figure 7:
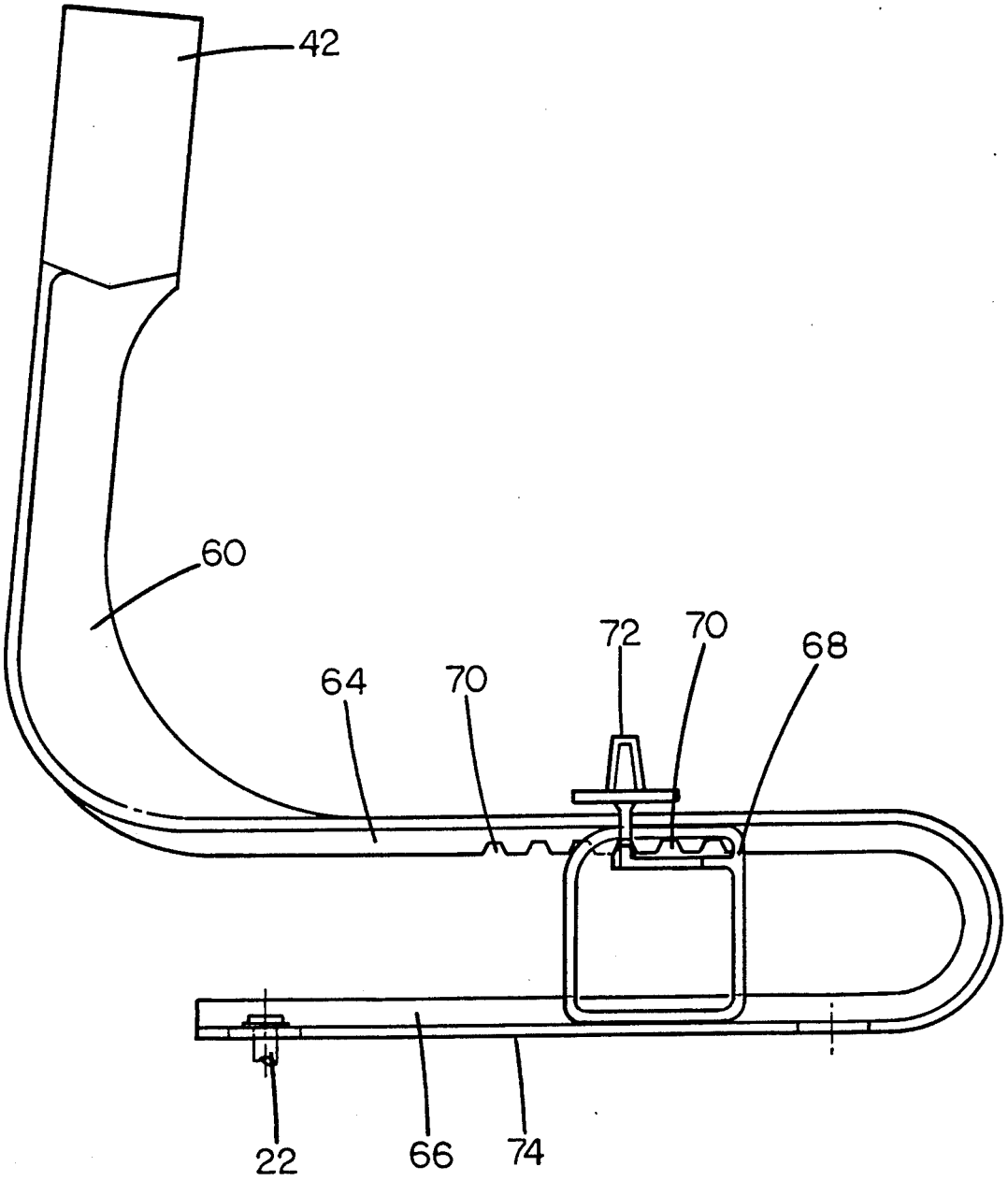
FIG. 7 is a partial side view of a base of the back support showing a variation in that the base has a U-shaped cross-section.

In FIG. 7, there is shown a side view of still a further variation of the invention where the base 60 has an upper cylindrical section 42 for fixedly receiving a lower end of the post 6 (not shown). The base 60 has a T-shaped cross-section and is U-shaped so that an upper portion 64 can move in a spring-like fashion relative to a lower portion 66. A rigid member 68 is shaped to fit within any one of slots 70 so that the rigid member 68 can be moved forward or backward within said slots by means of a handle 72. When the rigid member 68 is located in the most forward slot 70 (i.e. the slot that is located most toward the right-hand side of FIG. 7), the base 60 will be in its most spring-like position. Alternatively, when the rigid member 68 is located in the most rearward slot 70, the base 60 will have its least spring-like movement. Intermediate positions will provide intermediate spring-like conditions. If the rigid member 68 is removed entirely, the spring-like movement will greatly increase. A lower edge 74 is secured by bolts 22 through a supporting surface (not shown).

Figure 8:
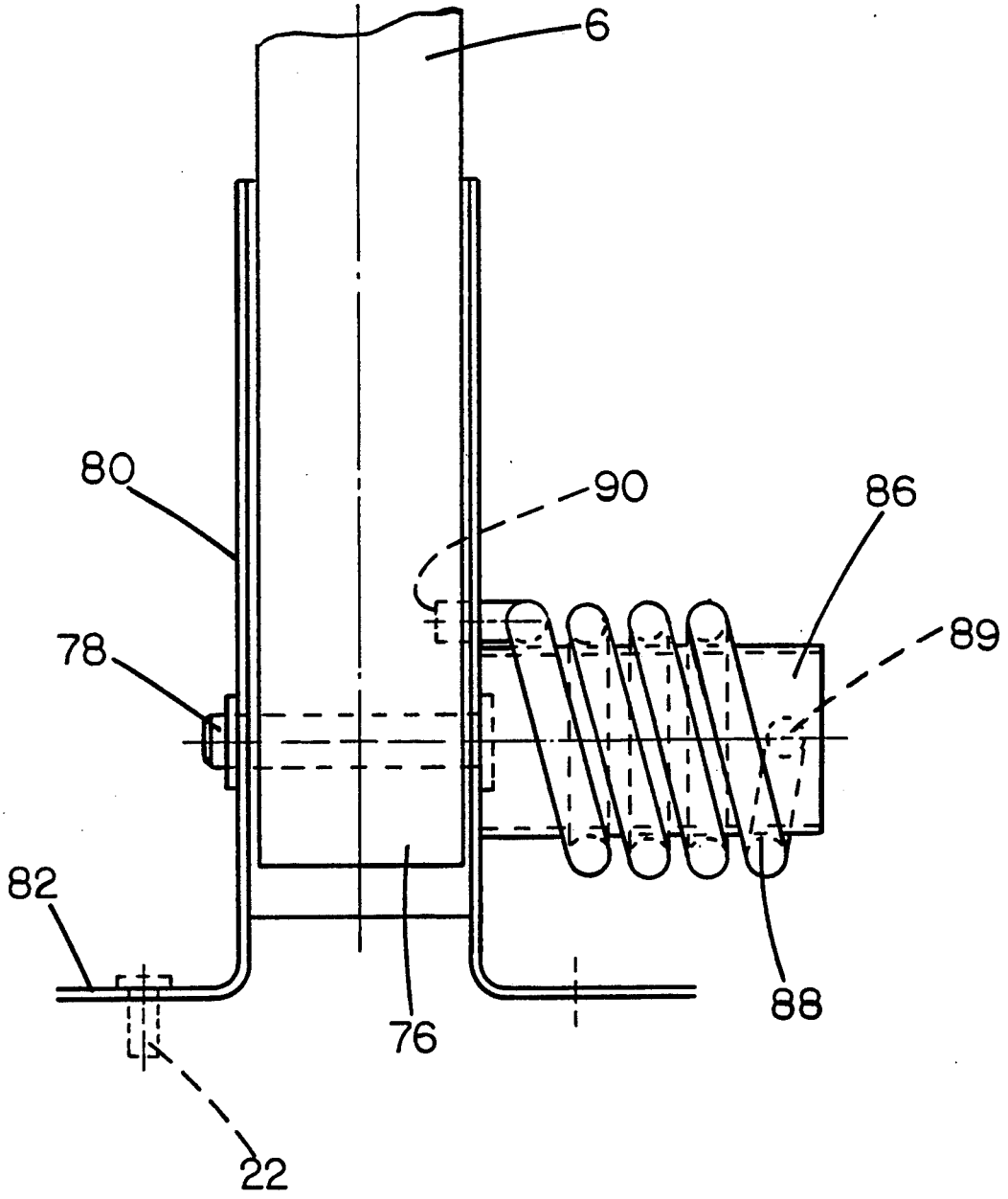
FIG. 8 is a partial side view of a base of the support having a side mounted spring.

In FIG. 8, there is shown still another variation of the spring-mounted aspect of the invention in which a lower end 76 of the post 6 is pivoted about a bolt 78 extending through a bracket 80 which has a suitable flange 82 at a lower end thereof to secure the bracket 80 to a supporting surface (not shown) by bolts 22 (only one of which is shown in FIG. 8). Affixed to one exterior side of the bracket 80 and surrounding an end of the bolt 78 is a cylinder 86. The cylinder 86 extends horizontally outward from the bracket 80. A spring 88 is sized to be mounted on said cylinder 86 with one end 89 of the spring secured within an opening (not shown) on said cylinder. An opposite end 90 of said spring extends through a suitably located slot (not shown) in the cylindrical bracket 80 and into an aligned opening (not shown) in the post 6. In operation, when the post is pivoted forward or backward, the end 90 of the spring will move with the post. The end of the spring affixed to the cylinder 86 will not move. Thus, the spring can easily be biased to provide resistance to any force applied to the back rest by a user and to return the back rest to its initial position when the user no longer rests or leans against it.

The various different features of providing a spring-mounting can be used separately or in combination with one another. Also, the post can be secured to a supporting surface as shown in FIG. 1 or it can be mounted directly into a supporting surface or floor in a manner similar to that shown in FIG. 6.

It can readily be seen that the back support of the present invention can provide significant rest to a user even if it can only be used for fifteen to thirty seconds every five minutes or so. In addition, for certain types of jobs, it may be possible to perform the job continuously leaning against the back support. Due to the resilient nature of the back support and due to the fact that the user remains in a standing position, very little energy need be expended by the user to become separated from the back support once it has been used.

What I claim as my invention is:

1. A back support for use by a user in a standing or leaning position, said support comprising a base, a longitudinal member having an upper end, a lower end and a front, with said lower end securely mounted to said base and said upper end extending slightly forward of said lower end when said support is in a rest position, said upper end supporting a back rest at said front, with adjustment means to adjust said position of the back rest to correspond to a level and orientation of a lower back of the user, the upper end of said longitudinal member being movable in a vertical plane so that when a user stands or leans against the back rest, said upper end moves rearward in response to a weight of the user and when the user moves away from said back rest, the upper end returns to said rest position, said support providing a resilient force in a forward direction to assist the user in separating from the support.

2. A back support as claimed in claim 1 wherein the longitudinal member is spring-mounted relative to said base, said spring-mounting being biased to force said upper end forward when the support is in a rest position.

3. A support as claimed in claim 2 wherein the spring-mounting is adjustable.

4. A support as claimed in claim 2 wherein the spring-mounting is achieved by securing the longitudinal member so that it can pivot in a vertical plane within a forward limitation and a rearward limitation, mounting a spring to bias the longitudinal member to said forward limitation when the support is in a rest position.

5. A support as claimed in claim 4 wherein the spring is under compression and is made adjustable by loosening or tightening a nut on a bolt extending along a longitudinal centre line of the spring.

6. A support as claimed in claim 1 wherein the movement in a vertical plane of the upper end and a forward bias is provided by the longitudinal member itself which is rigid but sufficiently resilient to bend slightly under the weight of a user and to return to a rest position when the user separates from the support.

7. A support as claimed in claim 1 wherein the movement of the longitudinal member in a vertical plane and a forward bias is provided by the lower end of the longitudinal member being formed into a horizontal U-shape with an open side of the U extending in a forward direction.

8. A support as claimed in claim 7 wherein there is a rigid member which is large enough to extend between an upper and lower side of the U, said rigid member being movable to various locations both forward and rearward to make the spring bias adjustable.

9. A support as claimed in claim 1 wherein the longitudinal member has two parts, one slidably fitting within the other with tightening means thereon so that the height of the back rest relative to the base can be adjusted.

10. A support as claimed in claim 2 wherein the base is mounted in a supporting surface.

11. A support as claimed in claim 1 wherein the back rest is mounted to the upper end of the elongated member by an inverted U-shaped member, the elongated member being rigid and the flexibility and resiliency being provided by the U-shaped member extending between the back rest and said upper end.

12. A support as claimed in claim 1 wherein the elongated member is releasably locked onto the base so that the elongated member and the back rest can be readily separated from the base.

* * * * *